United States Patent [19]

Shaw

[11] 4,196,715

[45] Apr. 8, 1980

[54] FIREPLACE CONVERTER

[75] Inventor: William S. Shaw, Prince George, Canada

[73] Assignee: Shaw's Modular Fireplaces, Ltd., Prince George, Canada

[21] Appl. No.: 886,892

[22] Filed: Mar. 15, 1978

[30] Foreign Application Priority Data

Nov. 7, 1977 [CA] Canada ..... 290383

[51] Int. Cl.[2] ..... F24B 7/00

[52] U.S. Cl. ..... 126/121

[58] Field of Search ..... 126/121, 131, 138, 139, 126/164, 143; 237/51

[56] References Cited

U.S. PATENT DOCUMENTS

| | | | |
|---|---|---|---|
| 1,608,745 | 11/1926 | Holbek | 126/121 |
| 1,697,635 | 1/1929 | Cornelius | 237/51 X |
| 2,375,318 | 5/1945 | Mudgett | 126/121 |
| 2,453,954 | 11/1948 | Wright | 237/51 |
| 2,725,874 | 12/1955 | Payne | 126/121 |
| 4,091,794 | 5/1978 | Stites | 126/121 |

FOREIGN PATENT DOCUMENTS

| | | | |
|---|---|---|---|
| 967406 | 8/1964 | United Kingdom | 126/121 |

*Primary Examiner*—Carroll B. Dority, Jr.
*Assistant Examiner*—Lee E. Barrett
*Attorney, Agent, or Firm*—LeBlanc, Nolan, Shur & Nies

[57] ABSTRACT

A device for converting an existing fireplace to an efficient space heater to fully utilize the heat generated by a fire therein without losing the aesthetic effect thereof is disclosed. The device includes a plenum chamber adapted to rest on the bottom surface of the fireplace, said chamber having a damper controlled draft inlet opening into the existing ash dump pit. The ash pit then serves as an air inlet conduit for air to be heated, and outside air may be supplied thereto by a fan. Pipes extend from the interior three edge portions of the chamber upwardly and around the fire wall and terminate framing the upper and side portions of the fireplace opening. A conventional fire grate is disposed on the upper surface of the chamber surrounded on three sides by said pipes. Air admitted to the plenum chamber then circulates through the pipes to be heated by a fire on the grate, and is then expelled into the room. The outlet openings for the pipes may be contained within a frame surrounding the fireplace opening which also mounts conventional glass doors.

9 Claims, 4 Drawing Figures

FIREPLACE CONVERTER

This invention relates to a device to be used in a conventional fireplace to efficiently utilize the heat generated by a fire therein. In addition, this device may be used to adapt the fireplace to efficient room heating and to pressurize a living area, thereby minimizing drafts of cold air which enter around windows, cracks, and the like.

As is well known, conventional fireplaces are extremely inefficient means for heating a living area. The heat generated by a conventional fireplace travels primarily up a chimney or flue in the form of convection currents of room air utilized for combustion air in the fireplace. While some radiant energy is generated, as a fire burns, air from within the room flows into the fireplace and up the chimney. This flows depressurizes the living area whereby outside air will be more likely to flow into the area around doors, windows, cracks and the like.

Various attempts have been made in the past to provide efficient fireplace-like heating units. In addition, devices adapted to convert an existing fireplace to a space heater or to partially utilize the heat generated by the fireplace are also known.

For example, in U.S. Pat. Nos. 2,375,318 and 3,001,521, air is circulated beneath the fire and into the room. These patents describe devices adapted to only partially utilize the heat generated by the fire in that in both instances, the air is warmed by conduction while the majority of the heat generated by the fire continues to travel up the chimney. The device described in U.S. Pat. No. 3,955,553 is an additional attempt to partially utilize the heat generated by the fireplace by providing pipes that extend below the grate behind the fire, and above the fire to ultimately open into the room whereby room air will be circulated through the pipes to be heated and exit into the room. This device however utilizes a highly visible series of pipes and fan circulating equipment which obviously detracts from the aesthetic appearance of the fireplace.

Other types of fireplace conversion units are shown, for example, in U.S. Pat. Nos. 2,143,722, 2,832,332, 2,863,443, and 3,096,754. While these devices may efficiently utilize the heat generated in the fireplace, installation requires extensive construction. Therefore, these devices would be utilized primarily in the instance of new construction rather than in conversion of existing fireplace.

In U.S. Pat. No. 2,161,723, a device is described wherein air is forced through a plurality of conduits which extend beneath, behind and above the fire in a fireplace. However, the air is expelled from a discharge manifold disposed above the fireplace opening. This device, as in the above-described patents, then, requires construction work in order to install and therefore is not readily adapted to an existing fireplace.

It has been discovered, however, that a space heater type of unit can be constructed which may be readily adapted to existing fireplaces without special construction. The unit of this invention, then, efficiently utilizes the heat generated by a fire while still maintaining the aesthetic appearance. In other words, the unit of this invention is readily adapted to an existing fireplace but does not intrude unduly upon the appearance thereof. Furthermore, the unit of this invention is adapted to utilize outside air which is heated and expelled into the living area at or near the floor level for uniform heating and for pressurization against drafts from around windows, doors, and the like.

The device utilizes a plenum chamber for collecting outside air to be heated, which chamber functions as a false bottom for the fireplace. Heat conducting conduits then extend from the chamber around the fire wall to surround the grate. Air passing through the conduits then is heated by a fire burning on the fireplace grate and expelled into the room through a manifold which surrounds the fireplace opening at the sides and upper portion thereof. The manifold in addition may support glass doors with a vent thereon to restrict the amount of room air utilized for combustion to an optimum amount.

Accordingly, it is an object of this invention to provide a device for converting an existing fireplace into an efficient space heater without an undue amount of construction.

It is another object to provide a heat exchanger for utilizing the heat generated by a fire in a fireplace to heat a living area.

It is another object to provide a means for pressurizing a living area with heated air from the outside wherein said air is conveyed through a plurality of conduits surrounding a fire in a fireplace and subsequently expelled into a room through a manifold.

It is yet another object of this invention to provide a fireplace converter useful to heat a living area which utilizes the heat generated by a fire in a fireplace without unduly diminishing the aesthetic effect thereof from a decorative standpoint.

It is yet another object to provide an efficient fireplace heater having a plenum chamber adapted to form a false bottom for supporting a grate, and a plurality of conduits surrounding the interior of a fireplace, which conduits serve to convey outside air from the plenum chamber therethrough wherein it is heated and expelled into a living area.

These and other objects will become readily apparent with reference to the drawings and following description wherein.

Figure 1:
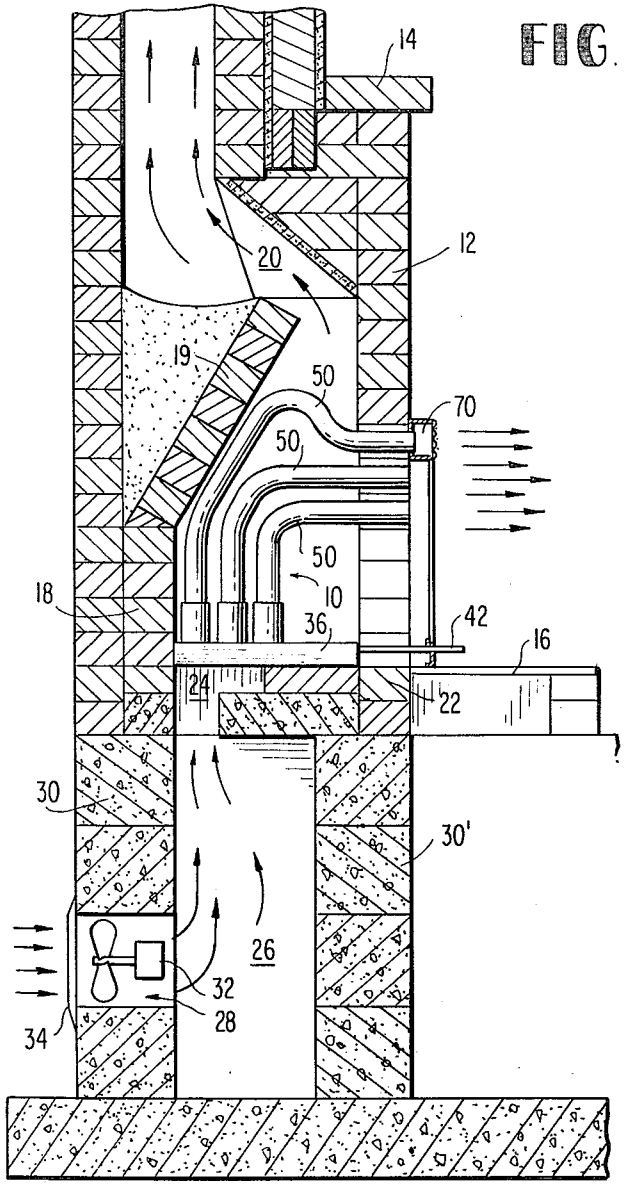
FIG. 1 is a cross-sectional side view of an installation incorporating the device of this invention.

With attention to the drawings and to FIG. 1 in particular, the fireplace converter 10 of this invention is readily adapted to an existing fireplace as follows:

An existing fireplace consists, in general, face brick 12 and a mantle 14. In addition, a hearth 16 is also usually present. These features are normally visible from the surrounding living area and the converter 10 of this invention, may be installed in an existing fireplace without altering these structural or decorative features. The interior of the fireplace consists of a fire wall 18 which extends around the interior of the fireplace having an upper angled portion 19 which terminates forming the flue 20. The floor or bottom wall of the fireplace 22 which supports a conventional grate (not shown) forms the opening 24 for an ash dump pit 26.

As is well known, the ash dump pit normally extends into a basement, or into a foundation supporting the living room area floor and wall. These structural features are also unchanged when the fireplace is adapted to the converter of this invention with one exception.

In a preferred embodiment of this invention, the converter may utilize a forced draft of outside air. In this embodiment, then, a hole 28 will be formed in the external foundation 30 which surrounds the ash dump pit 26. A conventional fan 32 may be mounted in the hole 28 to draw in outside air through, for example, a louvered opening or screen cover 34.

Figure 2:
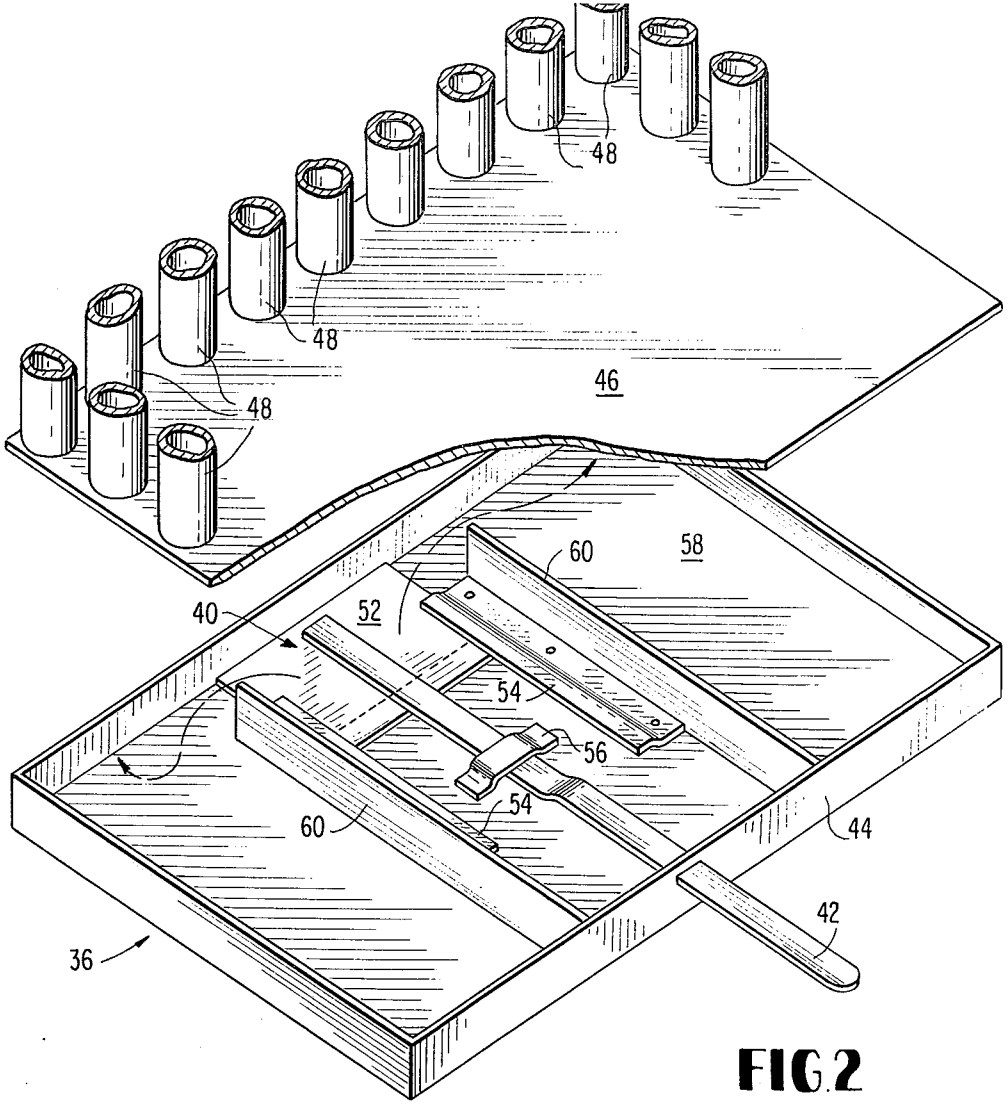
FIG. 2 is an exploded fragmentary view of the device of this invention.
Figure 3:
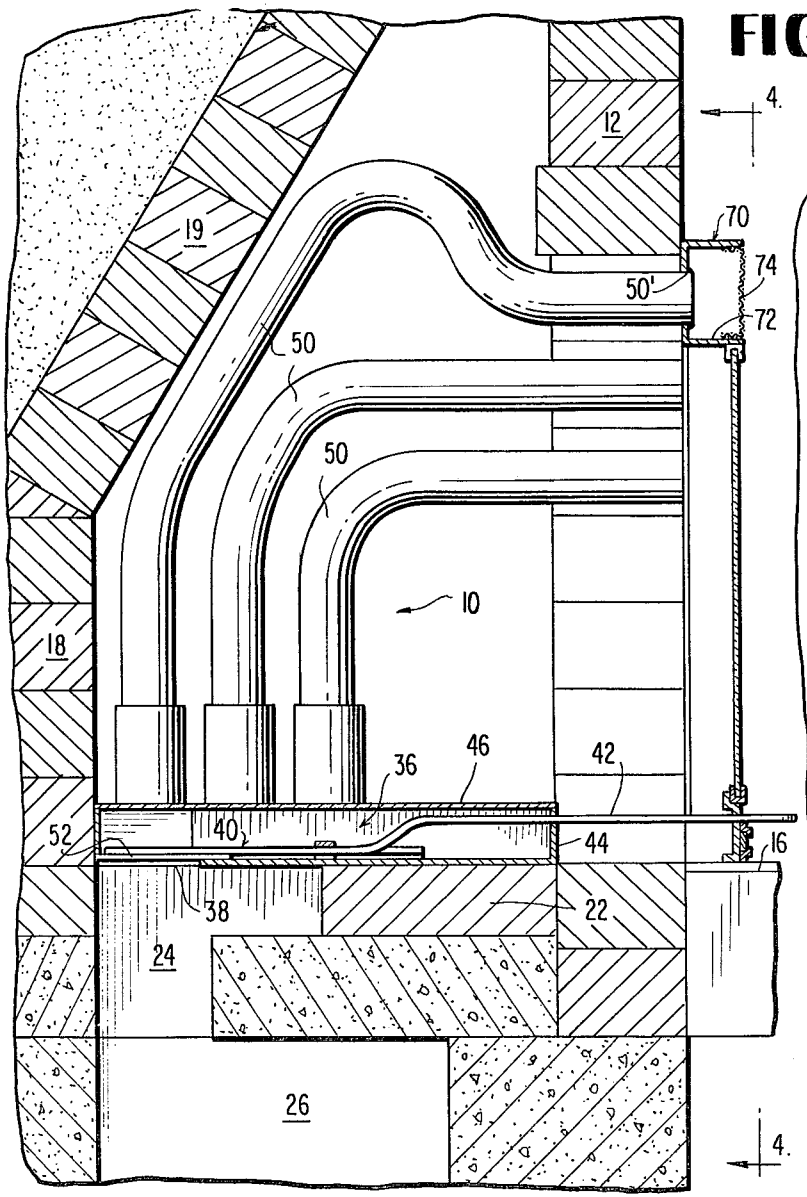
FIG. 3 is a fragmentary cross-sectional side view of the device of this invention as shown in FIG. 1.

With attention to FIGS. 2 and 3, the converter 10 of this invention comprises a lower plenum chamber 36 which is adapted to cover the existing fireplace floor 22, including the opening 24 formed for admitting ashes to the ash dump pit 26. The chamber 36 has an opening 38 to place the interior of chamber 36 into communication through opening 24 with the pit 26. The opening 38 is controlled by a damper 40. The handle 42 of damper 40 normally extends outwardly through the front wall 44 of chamber 36. Therefore, the flow of air from pit 26 into chamber 36 may be controlled externally by manipulation of the handle 42 as will be subsequently explained.

The upper plate 46 of chamber 36 mounts a plurality of conduits 48 which are mounted through the rear one-half thereof surrounding the periphery of plate 46. Conduits 48 then as shown in FIGS. 1 and 3, mount pipes 50 which surround the rear portion of the fireplace and are configured to conform to the contours thereof, including the angled portion 19 of the fire wall behind the fireplace. Conduits 50 then are intended to serve as a heat exchanger whereby air conveyed from the pit 26, through the plenum chamber 36, will be heated in conduits 50 and expelled into the room as shown in FIG. 1.

With attention to FIG. 2, the damper may be a conventional slide utilizing a plate 52 mounted on the end portion of handle 42 by welding. Movement of plate 52 is preferably guided by opposed guides 54 which overlap the lateral edge portion of plate 52, and by a guide 56 for the handle 42. Air then is admitted from the opening 24 through the opening 38 in the lower plate 58 of chamber 36. The air then circulates around opposed baffle plates 60 and enters conduits 48 and pipes 50 to pass upwardly and ultimately to be expelled into the room. The upper plate 46 of chamber 36 is intended to mount a conventional grate adjacent conduits 48. As a fire burns on said grate (not shown) the hot convection currents therefrom pass upwardly through the flue 20 as shown in FIG. 1, passing around and through pipes 50 whereby heat from said currents will be absorbed by said pipes and utilized to heat the air passing therethrough.

While outside air is preferably admitted by fan 32 to drum 26 for heating in the device of this invention 10, as will be obvious to those skilled in the art, the fan may be mounted internally at a conventional opening for cleaning the ash dump (not shown) in the interior wall 30'. Warm air from inside the house then would be recirculated through the device 10.

Figure 4:
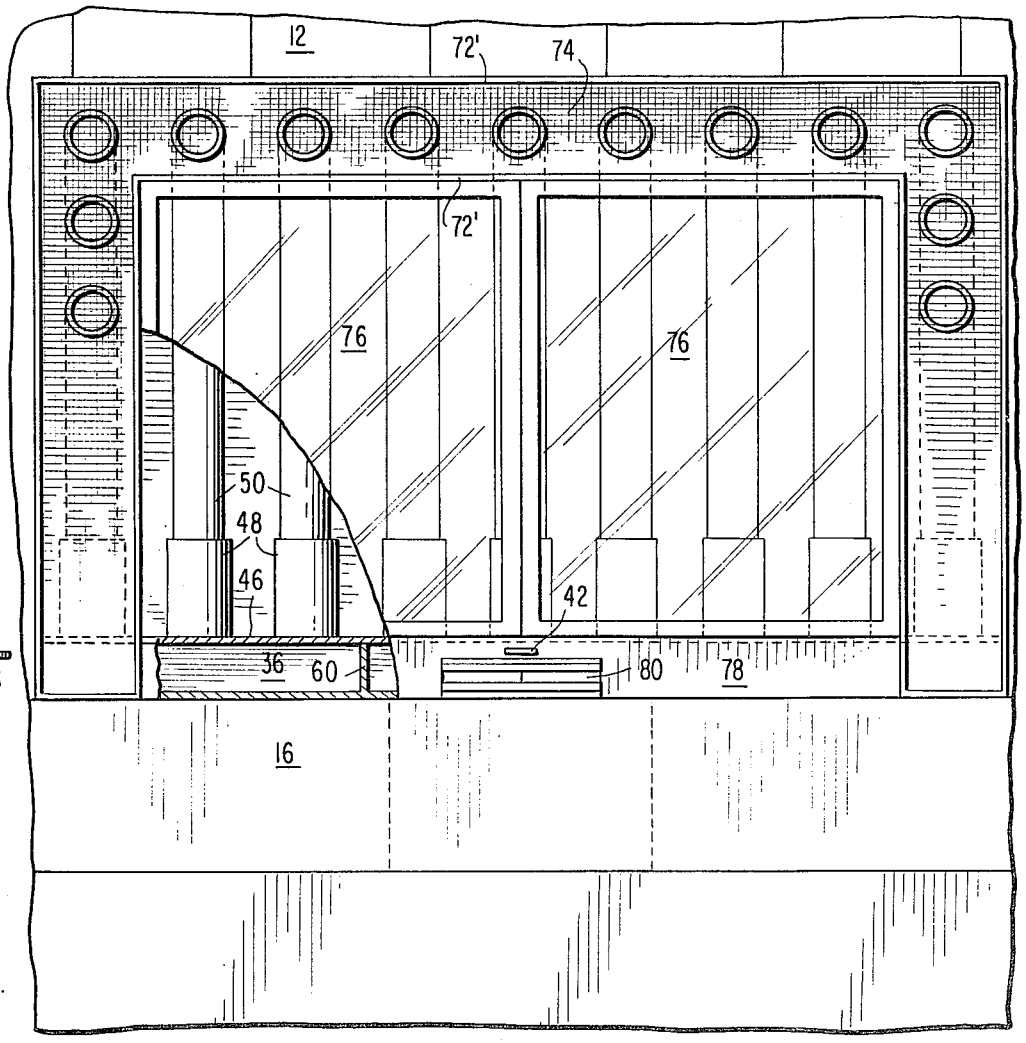
FIG. 4 is a fragmentary view taken along line 4—4 of FIG. 3 with a portion of the glass door broken away.

With attention to FIGS. 3 and 4, conduits 50 terminate in a manifold 70 which surrounds the fireplace opening formed by the face brick 12. The manifold 70 consists of a U-shaped channel 72 with a screen 74 covering the opening formed by the channel legs 72'. The terminal portion 50' of each conduit 50 extends into manifold 70.

As shown in FIG. 4 then, the converter of this invention forms, with plenum chamber 36, a false bottom for the fireplace. The sides, rear and upper portion thereof are faced with mutually spaced pipes 50 which conform to the contours thereof and terminate in a manifold which surrounds the sides and upper portion of the fireplace opening. As shown in FIG. 4, if desired, the fireplace opening may be covered with conventional glass doors 76 which are mounted on the interior leg portion 72' of channel member 72. The lower portion thereof may consist of a plate 78 which mounts a conventional vent 80, and damper handle 42. Accordingly, when doors 76 are closed, combustion air is supplied by vent 80, and if it is desired to extinguish the fire, combustion air thereto may be shut off merely by closing vent 80 in the conventional fashion.

In summary, then, the converter of this invention is adapted to be mounted in a conventional fireplace without altering the outward appearance thereof with additional vents in the facing brick or in the hearth. A heat exchanger is disposed abutting the fire wall in the fireplace, and a plenum chamber for supplying air to the heat exchanger serves as a false bottom for supporting a conventional grate. The construction necessary to implement the conversation of an existing fireplace according to this invention is limited to installation of a fan for supplying air through the ash pit of the fireplace to the plenum chamber disposed thereover. Air then circulates through the heat exchanger consisting of pipes 50 which extend around the sides of the fireplace and over the upper portion thereof and through the flue so that air admitted to the plenum chamber passes through the pipes is heated, and expelled through manifold 70 into the surrounding room.

If it is desired to extinguish the fire as, for example, if the users intend to retire, the fire may be extinguished by closing a vent on glass doors mounted on the manifold, and by closing the damper admitting outside air or air to be heated to the plenum chamber. In this way, the fireplace will be sealed when not in use against drafts and against the loss of heated air from within the room up the flue. When in use, the fireplace, obviously, may be operated without utilizing heated air, or preferably the amount of heated air admitted to the room may be controlled by opening the damper controlling the admission of air to be heated to the lower plenum chamber.

This invention is considered to reside in a device for converting an existing fireplace into an efficient space heater when a fire burns therein, said fireplace including interior back and side firewalls, the upper portion thereof forming an entrance to a flue, and an exterior opening into a living area, said fireplace further including a bottom surface for normally supporting andirons or a grate, said bottom surface forming an opening and an ash pit communicating with said fireplace through said opening for normally receiving ashes therefrom, said device comprising:

A horizontally disposed plenum chamber adapted to extend over the bottom surface of said fireplace, the lower surface of said chamber forming an opening adapted to register on the opening in said fireplace bottom surface so that the interior of said chamber is in communication with said ash pit therethrough, the upper surface of said chamber being adapted to mount a fire support means thereon; manifold means adapted to register on the exterior opening of said fireplace for framing the opening at both sides and across the top thereof, said means including a heated air outlet directed into the living area and a plurality of air inlets;

heat exchange means extending between said plenum chamber and said manifold means for conveying air to be heated from said chamber around the upper portion of said fire walls to said manifold means, said heat exchange means including a plurality of mutually spaced conduits adapted to extend from the rear peripheral portion of said chamber along the back and side fire walls of said fireplace terminating at mutually spaced air inlets in said manifold means; circulating means for circulating air to be heated from said pit, through the opening and through said plenum chamber, through said heat exchange means and thereby around the interior of said fireplace, through said manifold and into said living area; and damper means carried by device for selectively permitting a flow of air through the opening and into said plenum chamber.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced herein.

What is claimed and desired to be secured by Canadian Letters Patent is:

1. A device for converting an existing fireplace into an efficient space heater when a fire burns therein, said fireplace including interior back and side firewalls, the upper portions thereof forming an entrance to a flue, and a facing forming an exterior opening into a living area, said fireplace further including a bottom surface for normally supporting andirons or a grate, said bottom surface forming an opening and an ash pit communicating with said fireplace through said opening for normally receiving ashes therefrom, said device comprising:

a horizontally disposed plenum chamber adapted to extend over the bottom surface of said fireplace, the lower surface of said chamber forming an opening which registers on the opening in said fireplace bottom surface so that the interior of said chamber is in communication with said ash pit therethrough, the upper surface of said chamber being adapted to mount a fire support means thereon;

manifold means adapted to register on the fireplace facing for framing the exterior opening at both sides and across the top thereof, said means including an air outlet directed into the living area and a plurality of air inlets;

said manifold means further comprising a frame member having a channel-shaped cross section, said member adapted to be mounted with the base wall thereof abutting the fireplace facing and the side walls forming a horizontally directed air outlet, said frame at the upper portion of the sides and across the top thereof mounting in the base wall, a plurality of mutually spaced air inlets, and a screen covering the air outlet therein and connecting distal portions of opposite side walls of said frame member;

heat exchange means extending between said plenum chamber and said manifold means for conveying air to be heated from said chamber around the upper portion of said fire walls to said manifold means, said heat exchange means including a plurality of mutually spaced conduits adapted to extend from the rear peripheral portion of said chamber along the back and side fire walls of said fireplace terminating at the air inlets in said manifold means;

circulating means for circulating air to be heated from said pit, through the opening and through said plenum chamber, through said heat exchange means and thereby around the interior of said fireplace, through said manifold, and into said living area; and damper means carried by said device for selectively permitting a flow of air through the opening and into said plenum chamber.

2. The device of claim 1 further comprising means for admitting outside air to said pit for circulation through said device.

3. The device of claim 2 wherein said circulating means includes fan means in said pit for circulating air therefrom into said chamber and through said device.

4. The device of claim 1 wherein said damper means comprises a plate, slidably mounted within said chamber on the lower surface thereof, said plate adapted to move from a first position adjacent the opening in the surface of said chamber, to a second position covering the opening, and external handle means carried by said device by moving said plate from the first to the second position.

5. The device of claim 1 wherein said plenum chamber is formed by mutually spaced horizontally directed upper and lower plates interconnected by upstanding front, back and side walls, said upper plate having a plurality of mutually spaced air outlets therethrough disposed adjacent the back wall and the rear portions of each side wall, said device further comprising individual first coupling means mounted in each of said outlets for coupling an end of each of said heat exchanger conduits to said plate whereby each of said conduits will be in communication with said chamber therethough.

6. The device of claim 5 further comprising a plurality of individual second coupling means disposed at each of said air inlets in said manifold means for coupling an end of each of said heat exchange conduits to said base wall.

7. The device of claim 6 wherein said first and second coupling means are disposed in a common array on the upper plate of said chamber and the back wall of said frame, respectively, whereby heat exchange conduits will extend between individual first and second coupling means which occupy common positions in said array across the upper and side portions of said fireplace.

8. The device of claim 1 further comprising door means hingedly mounted on said frame member for controlling access to said fireplace through the external opening in said facing.

9. The device of claim 8 further comprising vent means carried by said door means for admitting only a predetermined flow of air from the living area through said door means.

* * * * *